US005110265A

United States Patent [19]

Kato et al.

[11] Patent Number: 5,110,265

[45] Date of Patent: May 5, 1992

[54] FUEL PUMP

[75] Inventors: Kiyoshi Kato; Isamu Suzuki; Seiji Toshima, all of Obu, Japan

[73] Assignee: Aisan Kogyo Kabushiki Kaisha, Aichi, Japan

[21] Appl. No.: 641,857

[22] Filed: Jan. 16, 1991

[51] Int. Cl.[5] ..... F04B 49/00; F04B 17/00; F04B 35/00; F04B 41/06

[52] U.S. Cl. ..... 417/279; 417/286; 417/287; 417/428; 417/363; 417/366

[58] Field of Search ..... 417/279, 286, 287, 428, 417/363, 366

[56] References Cited

U.S. PATENT DOCUMENTS

| | | | |
|---|---|---|---|
| 3,315,880 | 10/1965 | Kropiwnicki | 417/428 |
| 3,317,121 | 10/1965 | DeGroat | 417/428 |
| 4,780,067 | 10/1988 | Suzuki et al. | 417/286 |
| 4,961,693 | 10/1990 | Hoover et al. | 417/363 |
| 4,998,865 | 3/1991 | Nakanishi et al. | 417/366 |

FOREIGN PATENT DOCUMENTS 47-21843 6/1972 Japan .

*Primary Examiner*—Richard A. Bertsch
*Assistant Examiner*—Alfred Basichas
*Attorney, Agent, or Firm*—Dennison, Meserole, Pollack & Scheiner

[57] ABSTRACT

A fuel pump having a first pumping mechanism for pumping a fuel in a main tank to a subtank and having a second pumping mechanism for pumping the fuel in the subtank to an outside of the main tank. The fuel pump includes a rotatable impeller having a plurality of outer peripheral vanes, and a wall member surrounding the vanes so as to define a fuel flow passage. The wall member has two partition walls for partitioning the fuel flow passage into a first pumping passage and a second pumping passage, a first suction hole for communicating an upstream end of the first pumping passage to the main tank, a first discharge hole for communicating a downstream end of the first pumping passage to the subtank, a second suction hole for communicating an upstream end of the second pumping passage to the subtank, and a second discharge hole for communicating a downstream end of the second pumping passage out of the main tank.

16 Claims, 6 Drawing Sheets

FUEL PUMP

BACKGROUND OF THE INVENTION

The present invention relates to a fuel pump submerged in a fuel tank, and more particularly to a fuel pump for a motor vehicle improved in a pump efficiency.

A conventional fuel pump submerged in a fuel tank is designed to supply a constant amount of fuel to an engine for a motor vehicle even when a fuel surface of a low level in the fuel tank is inclined upon rapid acceleration, cornering or slope running of the motor vehicle.

Such a fuel pump is known from Japanese Patent Publication No. 47-21843, for example. This fuel pump includes first and second centrifugal pumping sections arranged in tandem perpendicularly to a fuel sucking direction. Each of the pumping sections has an impeller adapted to be rotated by a motor shaft. The first pumping section serves to pump the fuel in a main tank to a subtank, and the second pumping section serves to pump the fuel in the subtank to the engine. A discharge amount of the first pumping section is set to be larger than that of the second pumping section. Accordingly, a difference between a fuel amount to be fed from the main tank to the subtank by the first pumping section and a fuel amount to be fed from the subtank to the engine by the second pumping section is stored into the subtank. The subtank has an upper opening communicating with the main tank, so that when a fuel level in the subtank reaches a level of the upper opening, the fuel in the subtank is returned via the upper opening to the main tank. Accordingly, the fuel level in the subtank is always maintained at a constant level. With this construction, even when a fuel level in the main tank is low such that no fuel is temporarily sucked from a fuel inlet hole of the first pumping section, the fuel in the subtank is reliably fed to the engine.

In the above conventional fuel pump, the discharge amount of the first pumping section needs to be larger than that of the second pumping section in order to maintain the constant fuel level in the subtank. However, a discharge pressure of the first pumping section does not need to be so high because the first pumping section is used for the purpose of merely pumping the fuel in the main tank to the subtank. On the other hand, a high discharge pressure is required by the second pumping section because it is used for the purpose of feeding the fuel in the subtank to the engine. Particularly, when the engine is equipped with a fuel injection system, the discharge pressure of the second pumping section is set to normally 2 kg/cm$^2$ or more.

Generally, a rotating speed of each impeller of the fuel pump is set on the basis of the capacity of the second pumping section because a primary object of the fuel pump is to feed the fuel to the engine. However, since each impeller is rotated by the common motor shaft, the rotating speed of the impeller in the first pumping section is equal to that of the impeller in the second pumping section. As a result, the rotating speed of the impeller in the first pumping section is excessive to cause the generation of noise due to excess discharge pressure and flow.

Further, a high-power engine equipped with a supercharger requires a high pressure and high flow of the fuel pump. However, since this requirement is met by the second pumping section only, the size of the fuel pump or the rotating speed of each impeller must be increased, which causes a reduction in durability, increase in noise and increase in cost. Moreover, as the rotating speed of each impeller is increased, the discharge pressure and flow of the first pumping section become further excessive to result in a reduction in pump efficiency as a whole.

SUMMARY OF THE INVENTION

It is accordingly an object of the present invention to provide a fuel pump which may individually realize the pumping performance of the first pumping section for sucking the fuel in the main tank to the subtank and the second pumping section for feeding the fuel in the subtank to the engine, thereby improving the pump efficiency with low cost, high durability and low noise.

According to the present invention, there is provided , a fuel pump having a first pumping mechanism for pumping a fuel in a main tank to a subtank and having a second pumping mechanism for pumping the fuel in said subtank to an outside of said main tank, said fuel pump comprising a first rotatable impeller having a plurality of outer peripheral vanes; and a wall member surrounding said vanes so as to define a first fuel flow passage; said wall member having two partition walls for partitioning said fuel flow passage into a first pumping passage and a second pumping passage; a first suction opening for communicating an upstream end of said first pumping passage to said main tank; a first discharge opening for communicating a downstream end of said first pumping passage to said subtank; a second suction opening for communicating an upstream end of said second pumping passage to said subtank; and a second discharge opening for communicating a downstream end of said second pumping passage out of said main tank.

With this construction, the first pumping passage for constituting the first pumping mechanism is formed independently of the second pumping passage for constituting the second pumping mechanism. Accordingly, the discharge pressure of each pumping mechanism can be arbitrarily set by arbitrarily setting a length of each pumping passage. Furthermore, the discharge amount of each pump mechanism can also be arbitrarily set by arbitrarily setting a sectional area of each pumping passage.

The invention will be more fully understood from the following detailed description and appended claims when taken with the drawings.

DETAILED DESCRIPTION OF THE PREFERRED EMBODIMENTS

Figure 1:
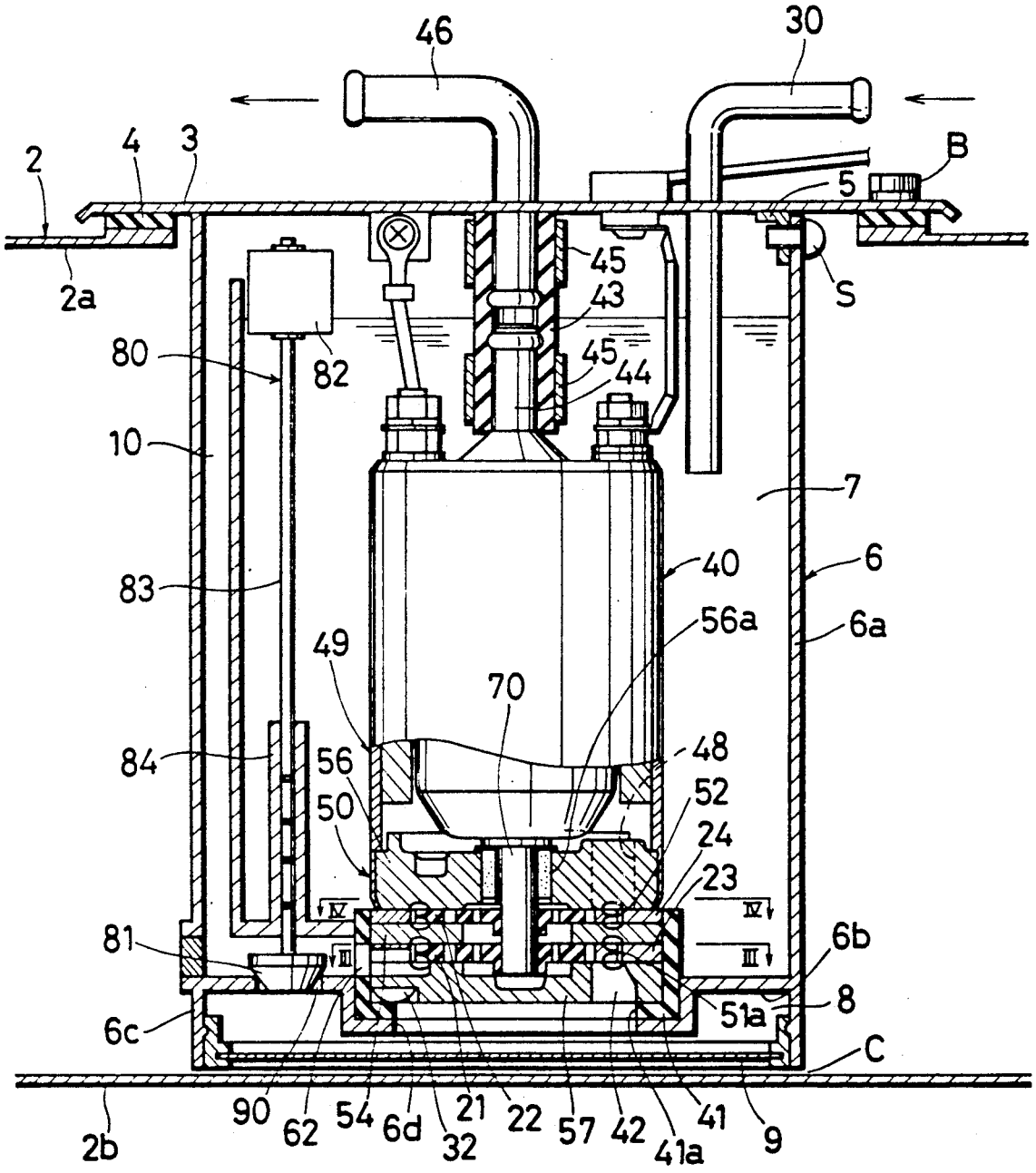
FIG. 1 is a vertical sectional view of a fuel supply system employing the fuel pump according to a first preferred embodiment of the present invention.
Figure 2:
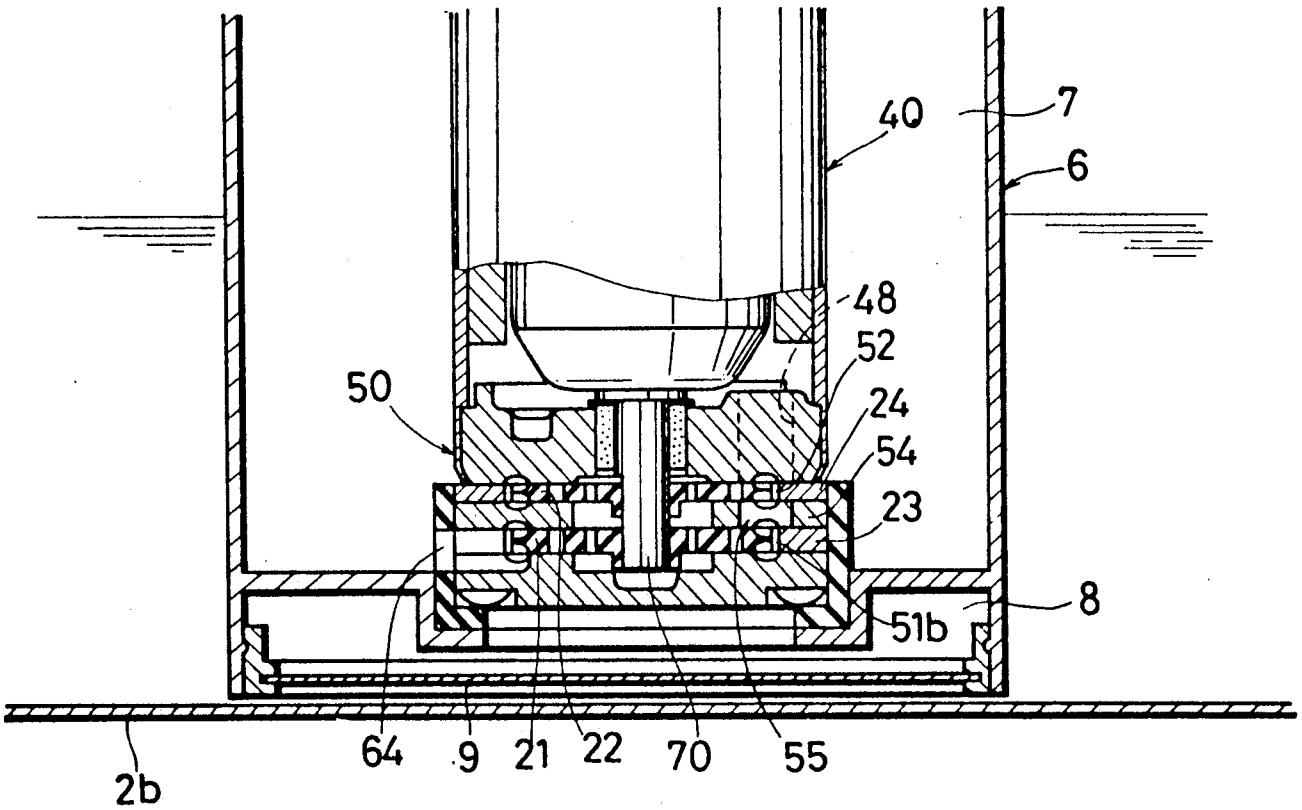
FIG. 2 is a view similar to FIG. 1, showing another section of the pump section.

Referring to FIGS. 1 to 4 which show a first preferred embodiment of the present invention, reference numeral 2 generally designates a main tank for storing a fuel to be supplied to an engine (not shown), and reference numeral 6 generally designates a subtank provided in the main tank 2 at a substantially central portion thereof. A top end of the subtank 2 is fixed through brackets 5 to a top plate 3. An outer peripheral portion of the top plate 3 is fixed through an annular gasket 4 to a top wall 2*a* of the main tank 2 by means of bolts B. The subtank 6 is formed of resin such as polyamide or polyacetal. Thus, the subtank 6 is suspended from the top plate 3 fixed to the top wall 2*a* of the main tank 2 so that a clearance C as a fuel passage is defined between a bottom end of the subtank 6 and a bottom wall 2*b* of the main tank 2. The subtank 6 is formed with a side wall 6*a* and a partition wall 6*b* projecting inwardly from a lower portion of the side wall 6*a*. A filter 9 is provided at the bottom end of the subtank 6, that is, at the bottom end of a lower extension 6*c* of the side wall 6*a* of the subtank 6. Thus, the internal space of the subtank 6 is generally partitioned by the partition wall 6*b* into an upper chamber or a float chamber 7 and a lower chamber or a filter chamber 8. The filter 9 is substantially planar, and it is opposed in parallel to the bottom wall 2*b* of the main tank 2 with the clearance C defined therebetween. The filter 9 is formed of nylon twilled fabric consisting of a weft (46/inch of 210 denier yarn) and a warp (163/inch of 220 denier yarn), so that high retention of the fuel in the filter chamber 8 is given by the filter 9 to prevent reverse flow of the fuel from the filter chamber 8 to the main tank 2.

A motor-driven fuel pump 40 is provided in the float chamber 7 of the subtank 6 at a substantially central portion thereof. The fuel pump 40 serves to pump up the fuel from the filter chamber 8 into the float chamber 7 and simultaneously feed the fuel from the float chamber 7 to the engine. The fuel pump 40 is supported at its lower end portion by a centrally recessed portion of the partition wall 6*b* through a cushion rubber member 41 for imparting a sealability and a vibroisolation. The centrally recessed portion of the partition wall 6*b* and the cushion rubber member 41 are formed with respective openings 6*d* and 41*a* communicating with a fuel inlet opening or hole 42 formed through a housing body 57 of a pump section 50 of the fuel pump 40. A rotor shaft 70 of a motor section 49 is inserted through a bearing hole 56*a* formed through a cover member 56 of the pump section 50. A first impeller 21 and a second impeller 22 are co-rotatably mounted on the rotor shaft 70. Each of the first impeller 21 and the second impeller 22 has a plurality of outer peripheral vanes for generating a high pumping pressure.

The first impeller 21 is axially surrounded by the housing body 57 on the lower side and an intermediate plate 54 on the upper side, and is also circumferentially surrounded by a first annular spacer 23. An axial clearance between the first impeller 21 and the housing body 57 or the intermediate plate 54 is set to 0.07 mm or less. On the other hand, the second impeller 22 is axially surrounded by the intermediate plate 54 on the lower side and the cover member 56 on the upper side, and is also circumferentially surrounded by a second annular spacer 24. An axial clearance between the second impeller 22 and the intermediate plate 54 or the cover member 56 is also set to 0.07 mm or less. All of the housing body 57, the intermediate plate 54, the first annular spacer 23 and the second annular spacer 24 are fixed by screws 32 to the cover member 56.

There is defined a first annular gap between the outer circumference of the first impeller 21 and the inner circumference of the first annular spacer 23, and there are formed first arcuate grooves on the opposed surfaces of the housing body 57 and the intermediate plate 54 so as to extend along the outer peripheral vanes of the first impeller 21. Thus, a first flow passage having a substantially C-shaped cross section is defined by the first annular gap and the first arcuate grooves around the vanes of the first impeller 21. Similarly, there is defined a second annular gap between the outer circumference of the second impeller 22 and the inner circumference of the second spacer 24, and there are formed second arcuate grooves on the opposed surfaces of the cover member 56 and the intermediate plate 54 so as to extend along the outer peripheral vanes of the second impeller 22. Thus, a second flow passage having a substantially C-shaped cross section is defined by the second annular gap and the second arcuate grooves around the vanes of the second impeller 22.

Figure 3:
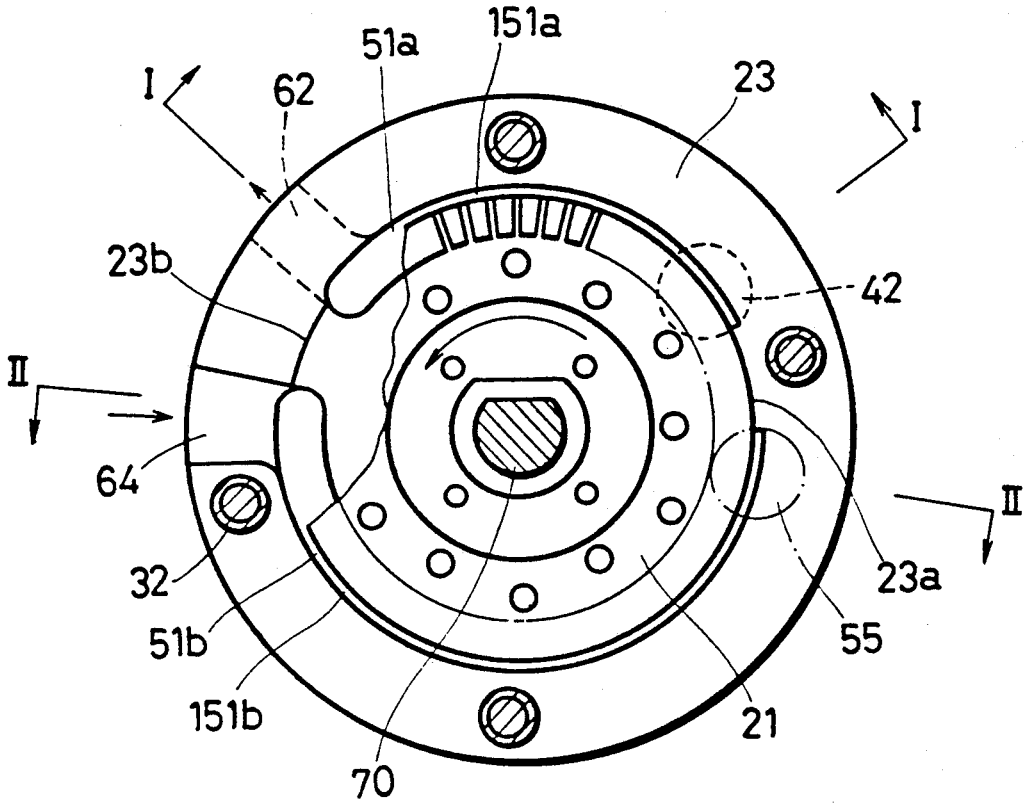
FIG. 3 is a cross section taken along the line III—III in FIG. 1, in which a cross section taken along the line I—I appears in FIG. 1, and a cross section taken along the line II—II appears in FIG. 2.

Referring to FIG. 3 which shows the first flow passage in plan (cross section taken along the line III—III in FIG. 1), the first flow passage is divided into a first pumping passage 151*a* and a second pumping passage 151*b*. That is, the first pumping passage 151*a* extends from the fuel inlet opening 42 of the housing body 57 to a discharge port 62 radially formed through the first spacer 23. On the other hand, the second pumping passage 151*b* extends from a suction port 64 radially formed through the first spacer 23 to a communication opening 55 axially formed through the intermediate plate 54 (see FIGS. 2 and 3).

Both the discharge port 62 and the suction port 64 are communicated with the float chamber 7 in the subtank 6. The communication opening 55 is communicated with the second flow passage around the second impeller 22. The first pumping passage 151*a* and the vanes of the first impeller 21 constitute a first pumping portion 51*a*, while the second pumping passage 151*b* and the vanes of the first impeller 21 constitute a second pumping portion 51*b*.

Reference numerals 23*a* and 23*b* denote first and second partition walls projecting radially inwardly from the inner circumference of the first spacer 23. The first partition wall 23*a* is so formed as to partition the upstream end of the first pumping passage 151*a* communicating with the fuel inlet opening 42 from the downstream end of the second pumping passage 151*b* communicating with the communication opening 55. On the other hand, the second partition wall 23*b* is so formed as to partition the downstream end of the first pumping passage 151*a* communicating with the discharge port 62 from the upstream end of the second pumping passage 151*b* communicating with the suction port 64. A radial clearance between the inner circumference of the first partition wall 23*a* and the outer circumference of the first impeller 21 is set to 0.1 mm or less, while a radial clearance between the inner circumference of the second partition wall 23*b* and the outer circumference of the first impeller 21 is set to 0.5 mm or less.

Figure 4:
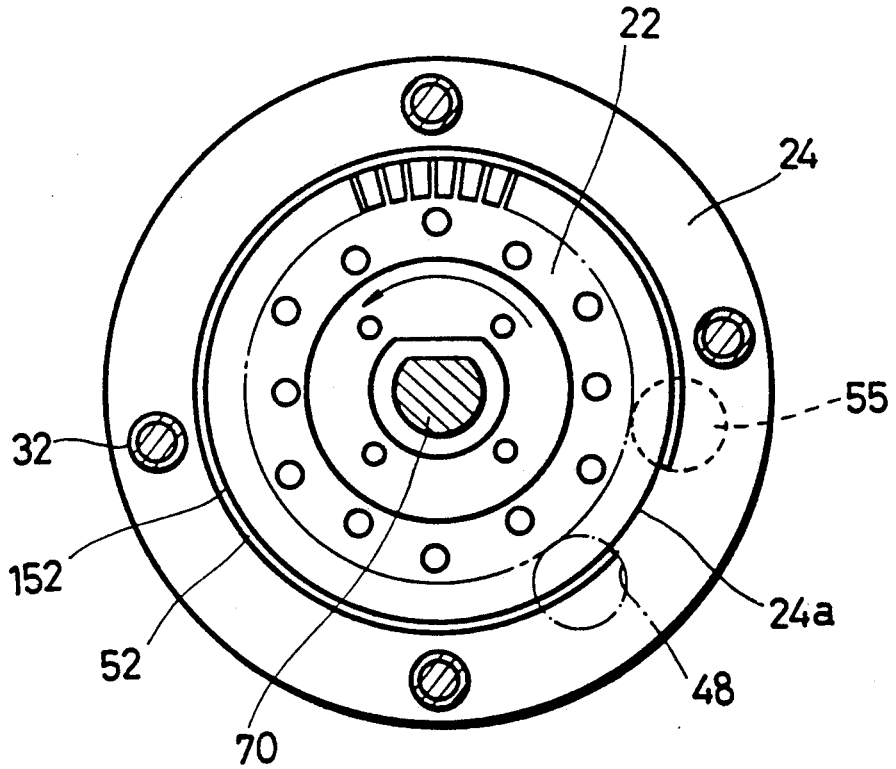
FIG. 4 is a cross section taken along the line IV—IV in FIG. 1.
Figure 5:
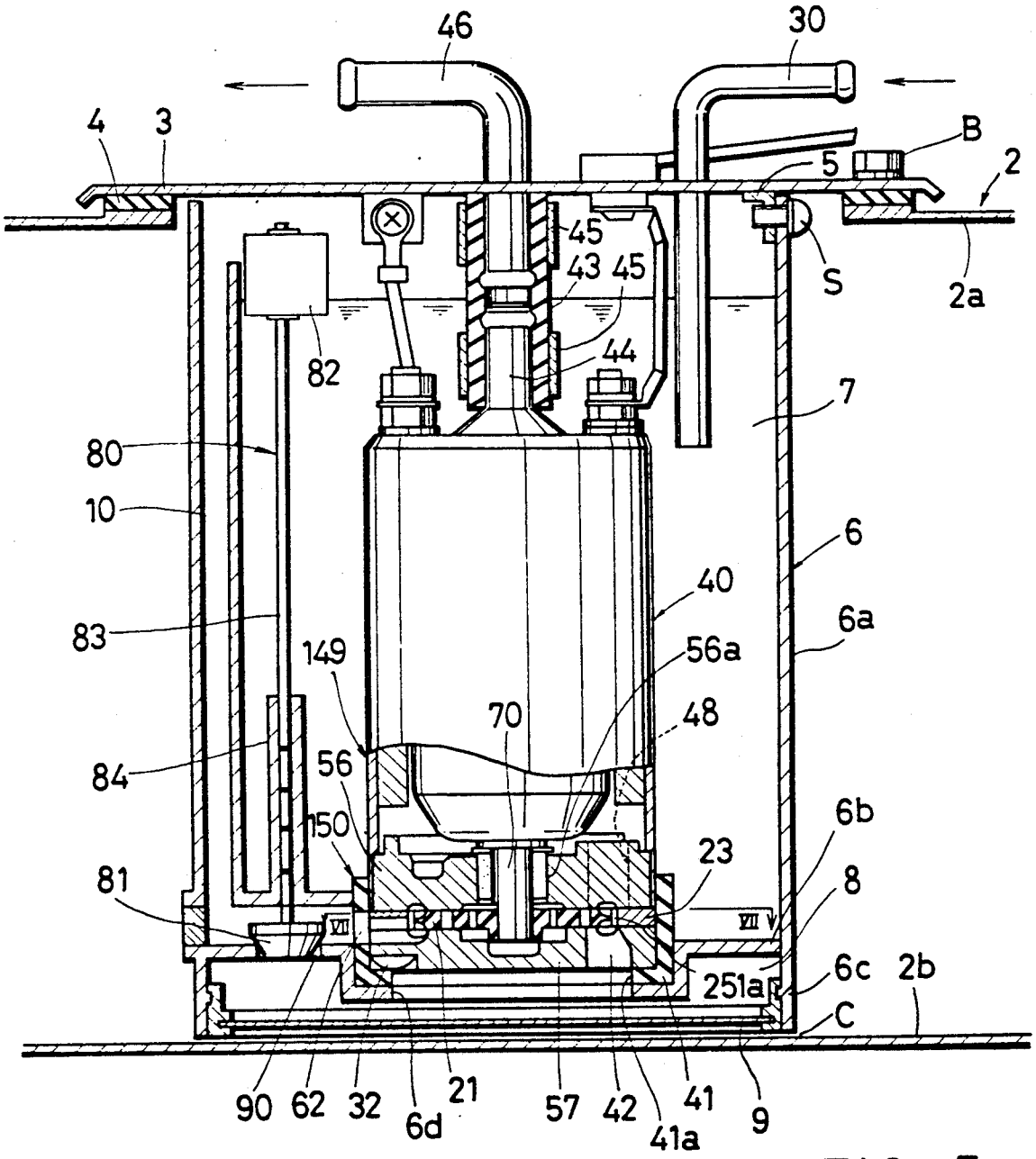
FIG. 5 is a view similar to FIG. 1, showing a second preferred embodiment.
Figure 6:
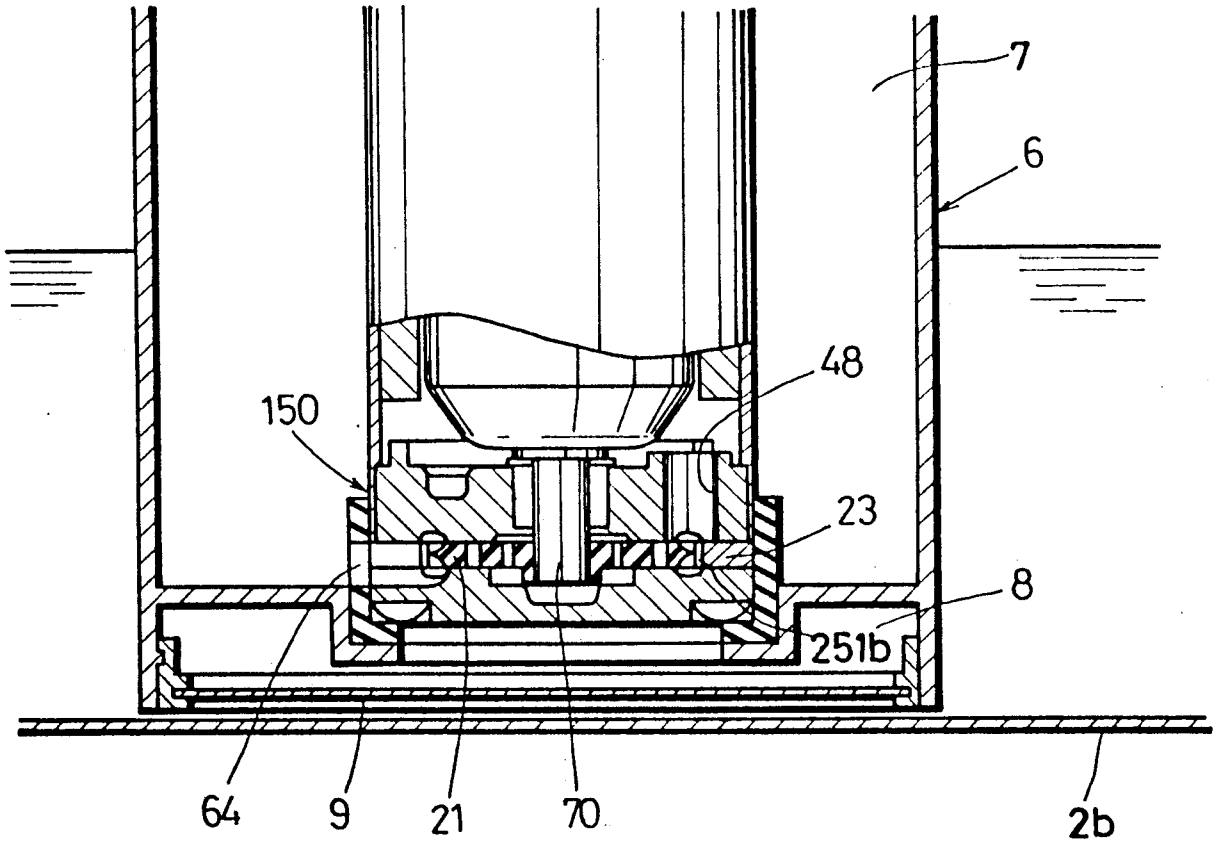
FIG. 6 is a view similar to FIG. 5, showing another section of the pump section.

Referring next to FIG. 4 which shows the second flow passage in plan (cross section taken along the line IV—IV in FIG. 1), the second flow passage is identified as a third pumping passage 152 extending from the communication hole 55 of the intermediate plate 54 to a fuel outlet or hole 48 axially formed through the cover member 56. The fuel outlet 48 is communicated with the motor section 49 in the housing of the fuel pump 40. The third pumping passage 152 and the vanes of the second impeller 22 constitute a third pumping portion 52. Reference numeral 24*a* denotes a third partition wall projecting radially inwardly from the inner circumference of the second spacer 24. The third partition wall 24*a* is so formed as to partition the upstream end of the third pumping passage 152 communicating with the communication hole 55 from the downstream end of the third pumping passage 152 communicating with the fuel outlet 48. A radial clearance between the inner circumference of the third partition wall 24*a* and the outer circumference of the second impeller 22 is set to 0.1 mm or less.

As mentioned above, the first pumping portion 51*a* and the second pumping portion 51*b* are independently formed by dividing the first flow passage around the first impeller 21. Accordingly, a discharge pressure in each pumping portion can be arbitrarily set by changing a ratio between a length of the first pumping passage 151*a* and a length of the second pumping passage 151*b*. Furthermore, a discharge amount in each pumping portion can be set by arbitrarily setting sectional areas of the first pumping passage 151*a* and the second pumping passage 151*b*. Thus, each pumping portion can therefore exhibit an individual pumping performance by arbitrarily setting the length and the sectional area of each pumping passage in combination. The sectional area of each pumping passage can be changed by changing a depth and/or a width of the arcuate grooves, and/or a thickness of each impeller. For example, when the length of each pumping passage is large, and the sectional area of each pumping passage is small, a high-pressure low-flow pump can be obtained. In contrast, when the length of each pumping passage is small, and the sectional area of each pumping passage is large, a low-pressure high-flow pump can be obtained.

In the first preferred embodiment, the length of the first pumping passage 151*a* of the first pumping portion 51*a* is set so as to generate a necessary pressure for pumping the fuel from the main tank 2 into the subtank 6, and the total length of the second and third pumping passages 151*b* and 152 of the second pumping portion 51*b* and the third pumping portion 52 is set so as to generate a necessary pressure for feeding the fuel from the subtank 6 to the engine. Further, the discharge amount from the first pumping portion 51*a* is substantially equal to that from the second pumping portion 51*b* by setting the sectional area of the first pumping passage 151*a* equal to that of the second pumping passage 151*b*. Further, the thickness of the first impeller 21 is made larger than that of the second impeller 22 to thereby avoid an insufficient discharge amount to be supplied to the third pumping portion 52. According to the above described construction, the pump efficiency is improved with low cost, high durability and low noise.

Referring back to FIG. 1, a fuel discharge portion 44 of the fuel pump 40 is connected through a rubber hose 43 ensuring vibroisolation and replacement to a fuel supply pipe 46 for supplying the fuel to the engine. The rubber hose 43 is firmly clamped by clips 45 to the fuel discharge portion 44 and the fuel supply pipe 46.

There is formed an L-shaped fuel passage 10 for supplying the fuel discharged from the discharge port 62 of the first pumping portion 51*a* to the float chamber 7 in the subtank 6. The fuel passage 10 has one end opening to an upper end portion of the float chamber 7 at a predetermined level, and has the other end communicated through the cushion rubber seal 41 to the discharge port 62 of the first pumping portion 51*a*. The fuel passage 10 can be communicated at its horizontal portion to the filter chamber 8 through a hole 90 formed through the partition wall 6*b* of the subtank 6.

A float valve 80 is so located as to open and close a circular opening or hole 90. The float valve 80 is comprised of a valve body 81 normally closing the hole 90, a float 82 located in the float chamber 7, and a connecting rod 83 connecting the valve body 81 with the float 82. The connecting rod 83 is vertically movably supported to a valve support 84 extending upwardly from the horizontal portion of the fuel passage 10. When a level of the fuel in the float chamber 7 becomes a predetermined level, the float 82 starts to float on the fuel surface, thereby lifting the valve body 81 to open the hole 90.

A fuel return pipe 30 is disposed to open into the float chamber 7, so as to return any unconsumed fuel from the engine to the subtank 6.

There will now be described the operation of the first preferred embodiment.

When the fuel pump 40 is driven under the condition where the fuel level in the float chamber 7 is substantially zero, the fuel in the filter chamber 8 is sucked from the fuel inlet hole 42 by the first pumping portion 51*a*, and is discharged from the discharge port 62 to the fuel passage 10. Then, the fuel is fed up through the fuel passage 10 to the float chamber 7. In this condition, since the fuel level in the float chamber 7 is substantially zero, the float 82 of the float valve 80 is not floated on the fuel surface, but it is gravitationally positioned to close the hole 90. Accordingly, the fuel in the fuel passage 10 does not flow into the filter chamber 8.

Then, the fuel supplied from the fuel passage 10 into the float chamber 7 is sucked from the suction port 64 by the second pumping portion 51*b*, and is fed to the third pumping portion 52. The fuel pressure is further boosted by the third pumping portion 52, and is fed through the motor section 49 to be discharged from the fuel outlet hole 44. Then, the fuel is supplied through the fuel supply pipe 46 to the engine.

An unconsumed part of the fuel supplied to the engine is returned through the fuel return pipe 30 to the subtank 6. Such an unconsumed fuel returned to the subtank 6 is a fuel having a high temperature and excluding a low-boiling point component.

As mentioned above, the sectional area of the first pumping passage 151*a* of the first pumping portion 51*a* is substantially equal to that of the second pumping passage 151*b* of the second pumping portion 51*b*. Therefore, a discharge amount from the first pumping portion 51*a* for feeding the fuel to the float chamber 7 is substantially equal to that from the second pumping portion 51*b* for feeding the fuel from the float chamber 7 to the engine. As a result, a fuel amount in the float chamber 7 is gradually increased by an amount of the fuel returned from the fuel return pipe 30. Accordingly, the fuel level in the float chamber 7 is gradually increased.

When the fuel level in the float chamber 7 reaches the predetermined level, the float 82 of the float valve 80 starts to float on the fuel surface and thereby lift the valve body 81 to open the hole 90. As a result, the fuel passage 10 is brought into communication with the filter chamber 8 through the hole 90, and the fuel discharged from the discharge port 62 is fed to the filter chamber 8. As the fuel fed from the fuel passage 10 through the hole 90 into the filter chamber 8 does not pass the filter 9, the pressure loss of this fuel is less than that of the fuel supplied from the main tank 2 through the filter 9 into the filter chamber 8. Therefore, the fuel fed through the hole 90 into the filter chamber 8 is preferentially sucked from the fuel inlet hole 42 as compared with the fuel fed through the filter 9 into the filter chamber 8.

Under the above condition where the hole 90 is opened, the fuel discharged from the discharge port 62 is not supplied through the fuel passage 10 to the float chamber 7, but is returned through the hole 90 into the filter chamber 8. Accordingly, the fuel amount in the float chamber 7 is gradually decreased by a difference between the fuel amount supplied to the engine and the fuel amount returned to the subtank 6. Thus, the fuel level in the float chamber 7 is gradually lowered, and accordingly the float 82 of the float valve 80 is also gradually lowered to start closing the hole 90. During the gradual closing of the hole 90, the fuel amount fed through the hole 90 into the filter chamber 8 is gradually reduced. In association with this, such a reduced amount of the fuel is fed through the fuel passage 10 into the float chamber 7. As a result, the lowering of the fuel level in the float chamber 7 is suppressed to approach the predetermined level. Thus, the reduction in the fuel amount in the float chamber 7 is compensated by the fuel to be supplied from the fuel passage 10.

As described above, the fuel returned from the engine through the fuel return pipe 30 to the subtank 6 is effectively supplied again to the engine, and such a return fuel having a high temperature and excluding a low-boiling point component is not mixed with the fuel having a relatively low temperature and including a large proportion of the low-boiling point component. Therefore, the generation of fuel vapor in the engine or the pump can be suppressed to thereby improve the pump efficiency. Further, a capacity of a vapor absorbing device can be reduced to make the structure compact.

Referring next to FIGS. 5 to 8 which show a second preferred embodiment of the present invention, the construction is generally similar to that of the first preferred embodiment except that a single impeller 21 is employed. In these drawings, the same parts as in the first preferred embodiment are designated by the same reference numerals, and the explanation thereof will be omitted.

Figure 7:
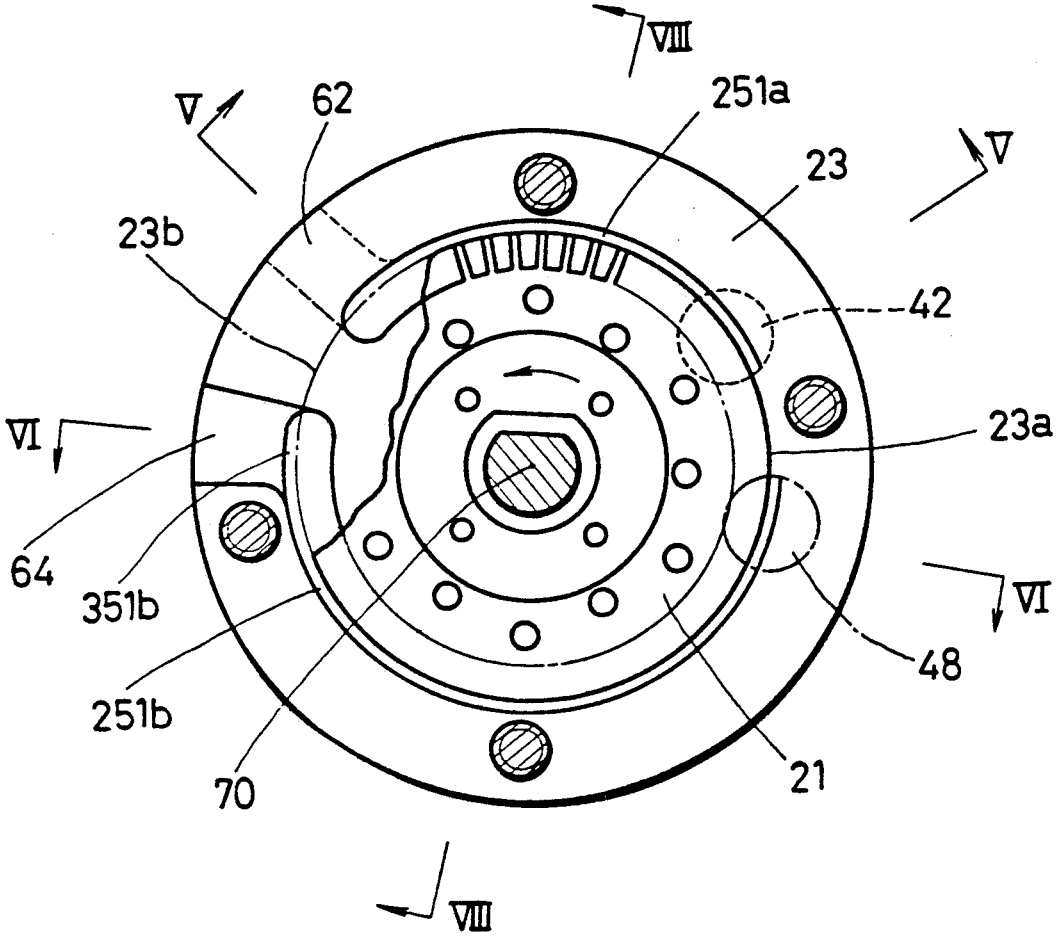
FIG. 7 is a cross section taken along the line VII—VII in FIG. 5, in which a cross section taken along the line V—V appears in FIG. 5, and a cross section taken along the line VI—VI appears in FIG. 6.
Figure 8:
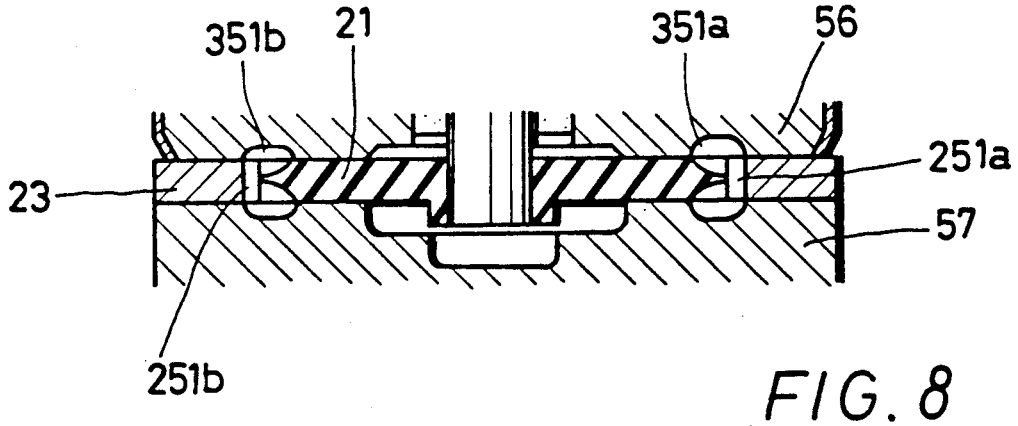
FIG. 8 is a cross section taken along the line VIII—VIII in FIG. 7.

As shown in FIG. 7 similar to FIG. 3, a fuel flow passage to be defined around the vanes of the impeller 21 is divided into a first pumping passage 351*a* and a second pumping passage 351*b* to thereby form a first pumping portion 251*a* and a second portion 251*b*, respectively. A length of the first pumping passage 351*a* of the first pumping portion 251*a* is set so as to generate a necessary minimum pressure for pumping up the fuel in the main tank 2 to the subtank 6. On the hand, a length of the second pumping passage 351*b* of pumping portion 251*b* is set so as to generate a for feeding the fuel in the subtank 6 to the e Furthermore, as shown in FIG. 8, a sectional area of first pumping passage 351*a* is larger than that of the pumping passage 351*b*, so that the first pumping portion 251*a* can supply a fuel amount larger than that by the pumping portion 251*b* to thereby avoid idle feed of the fuel by the second pumping portion 251*b*. The sectional area of the second pumping passage 351*b* is decided in consideration of a maximum fuel consumption of the engine, and the sectional area of the first pumping passage 351*a* is set so as to ensure a sufficient fuel feed amount by the second pumping portion 251*b*.

As described above, according to the second preferred embodiment, the length and the sectional area of each pumping passage are specially set for each pumping portion, thereby improving the pump efficiency. Further, as the single impeller is employed, the effect similar to that in the first preferred embodiment can be achieved with a further simple and compact construction.

Having thus described the preferred embodiments of the invention, it should be understood that numerous structural modifications and adaptations may be made without departing from the spirit of the invention.

What is claimed is:

1. A fuel pump having a first pumping mechanism for pumping a fuel in a main tank to a subtank and having a second pumping mechanism for pumping the fuel in said subtank to an outside of said main tank, said fuel pump comprising:

a first rotatable impeller having a plurality of outer peripheral vanes; and a wall member means surrounding the vanes of said first rotatable impeller to define a first fuel flow passage;

said wall member means having:

two partition walls for partitioning said first fuel flow passage into a first pumping passage and a second pumping passage;

and spacer means including a first suction opening for communicating an upstream end of said first pumping passage to said main tank;

a first discharge opening for communicating a downstream end of said first pumping passage to said subtank;

a second suction opening for communicating an upstream end of said second pumping passage to said subtank;

a second discharge opening for communicating a downstream end of said second pumping passage out of said main tank.

2. The fuel pump as defined in claim 1 further comprising a second rotatable impeller having a plurality of outer peripheral vanes and adapted to be rotated with said first rotatable impeller at the same speed;

said wall member surrounding said vanes of said first impeller and said second impeller so as to define said first fuel flow passage and a second fuel flow passage, respectively; and said first pumping passage being formed as a part of said first fuel flow passage.

3. The fuel pump as defined in claim 1, wherein said subtank has a lower wall spaced with a gap from a bottom surface of said main tank, said lower wall having a throughopening for communicating said first suction hole to said main tank.

4. The fuel pump as defined in claim 3, wherein said first discharge opening and said second suction opening extend through said wall member in a radial direction of said first impeller.

5. The fuel pump as defined in claim 1, wherein a length of said first pumping passage is smaller than that of said second pumping passage so as to obtain a discharge pressure of said first pumping passage smaller than that of said second pumping passage, and/or a sectional area of said first pumping passage is equal to or larger than that of said second pumping passage so as to obtain a discharge amount of said first pumping passage equal to or larger than that of said second pumping passage.

6. A fuel supply system comprising:

a main tank for storing a fuel;

a subtank provided in said main tank for storing a part of the fuel to be supplied from said main tank; and a fuel pump having a first pumping mechanism for pumping the fuel in said main tank to said subtank and having a second pumping mechanism for pumping the fuel in said subtank out of said main tank;

said fuel pump comprising:

a first rotatable impeller having a plurality of outer peripheral vanes;

wall member means surrounding said vanes so as to define a first fuel flow passage;

said wall member means having two partition walls for partitioning said first fuel flow passage into a first pumping passage and a second pumping passage;

and spacer means including a first suction opening for communicating an upstream end of said first pumping passage to said main tank;

a first discharge opening for communicating a downstream end of said first pumping passage to said subtank;

a second suction opening for communicating an upstream end of said second pumping passage to said subtank; and a second discharge opening for communicating a downstream end of said second pumping passage out of said main tank.

7. The fuel supply system as defined in claim 6, wherein said subtank has a lower wall spaced with a gap from a bottom surface of said main tank, said lower wall having a first through-hole and a side extension wall extending downwardly from said lower wall, said side extension wall being provided at its bottom end with a filter opposed to the bottom surface of said main tank, so that a filter chamber is defined by said lower wall, said side extension wall and said filter, and that said first suction opening is communicated through said first through-hole, said filter chamber and said filter to said main tank.

8. The fuel supply system as defined in claim 7 further comprising a fuel passage having one end communicated with said first discharge opening and the other end communicated with said subtank at an upper position thereof.

9. The fuel supply system as defined in claim 7, wherein said lower wall of said subtank has a second throughopening for communicating said first discharge hole to said filter chamber, further comprising a float valve adapted to open said second through-hole when a level of the fuel in said subtank reaches a predetermined level and close said second through-hole when the fuel level does not reach the predetermined level.

10. The fuel supply system as defined in claim 9 further comprising a fuel return pipe for returning at least a portion of the fuel pumped out of said main tank by said fuel pump to said subtank.

11. The fuel supply system as defined in claim 7, wherein said filter is horizontally disposed at a position close to the bottom surface of said main tank.

12. A motor-driven fuel pump comprising:

a motor having a rotating shaft;

a cover member located below said motor and rotatably supporting said rotating shaft;

a first annular spacer located below said cover member;

a housing body located below said first annular spacer; and a first impeller located in a space defined by said cover member, said first annular spacer and said housing body so as to be rotated by said rotating shaft;

said first annular spacer having two partition walls projecting radially inward close to an outer circumference to said first impeller at circumferentially given intervals so that first and second pumping passages are formed to surround the outer circumference of said first impeller and said pumping passages are partitioned by said two partition walls;

said housing body is formed with a first suction opening communicating with an upstream end of said first pumping passage;

said first annular spacer is formed with a first discharge opening communicating with a downstream end of said first pumping passage, and is also formed with a second suction opening communicating with an upstream end of said second pumping passage; and said cover member is formed with a second discharge opening communicating with a downstream end of said second pumping passage.

13. The motor-driven fuel pump as defined in claim 12, wherein a length of said first pumping passage is smaller than that of said second pumping passage so as to obtain a discharge pressure of said first pumping passage smaller than that of said second pumping passage, and/or a sectional area of said first pumping passage is equal to or larger than that of said second pumping passage so as to obtain a discharge amount of said first pumping passage equal to or larger than that of said second pumping passage.

14. The motor-driven fuel pump as defined in claim 12 further comprising:

a second annular spacer located below said cover member and above said first annular spacer;

an intermediate plate interposed between said first annular spacer and said second annular spacer; and a second impeller located in a space defined by said cover member, said second annular spacer and said intermediate plate so as to be rotated by said rotating shaft;

wherein a third pumping passage is so formed as to surround an outer circumference of said second impeller;

said intermediate plate is formed with a through-hole for communicating the downstream end of said second pumping passage to an upstream end of said third pumping passage; and a downstream end of said third pumping passage is communicated with said second discharge opening of said cover member.

15. The motor-driven fuel pump as defined in claim 14, wherein a length of said first pumping passage is smaller than a total length of said second and third pumping passages so as to obtain a discharge pressure of said first pumping passage smaller than that of said second and third pumping passages, and/or a sectional area of said first pumping passage is equal to or larger than that of said second and third pumping passages so as to obtain a discharge amount of said first pumping passage equal to or larger than that of said second and third pumping passages.

16. The motor-driven fuel pump as defined in claim 15, wherein a thickness of said first impeller is larger than that of said second impeller, so that the sectional area of said first pumping passage is equal to that of said second pumping passage, and is larger than that of said third pumping passage.

* * * * *